US006519423B2

(12) United States Patent
Dreher et al.

(10) Patent No.: US 6,519,423 B2
(45) Date of Patent: Feb. 11, 2003

(54) METHOD AND APPARATUS FOR SETTING REGISTRATION IN A MULTICOLOR PRINTING MACHINE BASED ON PRINTING SUBSTRATE GRADE

(75) Inventors: Ingo Klaus Dreher, Kiel (DE); Christopher Liston, Rochester, NY (US); Patrick Metzler, Gettorf (DE); Karlheinz Walter Peter, Molfsee (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/858,046

(22) Filed: May 15, 2001

(65) Prior Publication Data

US 2001/0043816 A1 Nov. 22, 2001

Related U.S. Application Data

(60) Provisional application No. 60/204,695, filed on May 17, 2000.

(51) Int. Cl.[7] ..... G03G 15/00

(52) U.S. Cl. ..... 399/45; 399/301

(58) Field of Search ..... 399/45, 39, 40, 399/46, 301, 298, 223, 313

(56) References Cited

U.S. PATENT DOCUMENTS 5,966,559 A * 10/1999 May et al. ..... 399/45
6,148,159 A * 11/2000 Shiraishi ..... 399/44

FOREIGN PATENT DOCUMENTS

JP 7-104586 * 4/1995
JP 10260562 * 9/1998

* cited by examiner

*Primary Examiner*—Quana M. Grainger
(74) *Attorney, Agent, or Firm*—Lawrence P. Kessler

(57) ABSTRACT

A method and apparatus for setting registration in a multicolor printing machine for the digital production of color separations, the actions of setting up and combining color separations being controlled when printing substrates of a different grade are fed in, in order to correct registration setting. In the event of a change in the printing substrate grade, the influence of this change on registration can be compensated for optimally before the printing substrate (16) is fed to the printing process. When the printing substrate grade is changed, the influence of all the properties of the printing substrate (16) that are relevant to registration is taken into account directly as the change is implemented, by correction values (4, 4', . . . ) for the printing substrate (16) that are available before printing is carried out.

20 Claims, 2 Drawing Sheets

METHOD AND APPARATUS FOR SETTING REGISTRATION IN A MULTICOLOR PRINTING MACHINE BASED ON PRINTING SUBSTRATE GRADE

CROSS REFERENCE TO RELATED APPLICATION

Reference is made to and priority claimed from U.S. Provisional Application Serial No. 60/204,695, filed on MAY 17, 2000, entitled: METHOD AND APPARATUS FOR SETTING REGISTER IN A MULTICOLOR PRINTING MACHINE.

BACKGROUND OF THE INVENTION

Field of the Invention

The invention relates to a method and apparatus for setting registration in a multicolor printing machine having a number of exposure devices for the digital production of color separations, the actions of setting up and combining the color separations being controlled when printing substrates of a different grade are fed in, in order to correct the registration setting.

Printing colored illustrations, in particular colored images, is carried out, for example, by a number of color separations being printed over one another. These are generally the colors yellow, magenta and cyan, as well as black. If required, special colors are added. By overprinting these colors, all color combinations can be achieved, the quality of the prints depending significantly on the in-register overprinting of the color separations. In the case of digital printing processes, for example, electrostatic printing processes, the maintenance of the registration of the overprint is achieved by the image production devices being controlled such that the color separations meet one another in-register when they are transferred to a printing substrate.

A method and an apparatus for color printing are disclosed by U.S Pat. No. 5,689,757. The teaching of this document is to take account of the influence of the roughness of the paper on the registration when printing substrates of a different grade are fed in. For this purpose, the roughness of a paper, which is to be printed, is measured. The influence of the paper roughness on registration is then taken into account by the registration controller before the paper is fed to the printing process.

It has been shown that influencing the registration accuracy, as a result of changing the printing substrate grade, can be detected only inadequately in this way, so that a high print quality cannot be achieved. The reason for this is that the influence of the change in the substrate grade cannot be detected by a single property. In addition, the paper roughness is, first of all, not the property, which exerts the greatest influence on the registration. This leads to the situation where satisfactory registration accuracy can be achieved only by a correction, which is based on evaluating the printing result. The disadvantage of setting the registration by evaluating the printing result, for example, by registration marks, is, however, that in the event of a change in the printing substrate grade, counteractive control is only possible for the print which follows a print which is faulty because of the change, since the effect of the change in an influencing variable is only detected when it has already caused a registration fault. Changes to the substrate during a print job are, therefore, not possible.

SUMMARY OF THE INVENTION

The invention is, therefore, based on the object of a method and an apparatus such that in the event of a change in the printing substrate grade, the influence of this change on registration can be compensated for optimally before the printing substrate is fed to the printing process. According to the invention, the object is achieved with respect to the method and apparatus, in that when the printing substrate grade is changed, the influence of all the properties of the printing substrate that are relevant to registration is taken into account directly as the change is implemented, by correction values for the printing substrate that are available before printing is carried out. At least one controller is provided that when the printing substrate grade is changed, the influence of all the properties of the printing substrate that are relevant to registration is taken into account directly as the change is implemented, by available correction values for the printing substrate.

The invention is based on the finding that there are a number of properties of printing substrates which have an influence on registration, and optimum compensation of the influences of these properties when the printing substrate grade is changed is possible only when the sum of the influences of all the properties that are relevant in this regard is taken into account. If significant properties remain unconsidered, there remains only the subsequent correction, mentioned at the beginning, by evaluation of a proof result.

For instance, it has been shown that a significant influencing variable with regard to registration is the printing substrate thickness. This is because the movements of the elements carrying the color separations and substrates are linked to one another by friction. Here, as a result of a change in the printing substrate thickness, the radius, which is critical for the transmission ratio between the printing substrate carrier and a cylinder, is changed. This changing transmission ratio affects registration to a significantly greater extent than the paper roughness.

However, in addition to the printing substrate thickness and the surface roughness, there are still further properties of a printing substrate which have an influence on registration, such as the compressibility or the flexing of the printing substrate during printing, the stiffness or changes resulting from toner uptake or heating.

The invention achieves an optimum correction, since the sum of all these influences is taken into account, without it mattering which and how many properties of the printing substrate have what influence. In addition, it is possible to include changes in the properties of a printing substrate within the machine, if these properties change from one printing unit to the next as a result of heating, flexing or printing with one or more color separations. For this case, the correction values for the individual printing units are correspondingly different.

The invention, therefore makes, it possible for the occurrence of a registration fault to be prevented from the outset, so that proofs on printing substrates, for example, with registration marks, are normally no longer needed. It is precisely in the case of small jobs or for printing on printed pages with continually changing paper grades that this is of economic importance, since machine time and often also printing substrates can be saved. In addition, the measure according to the invention makes proofs on the printing substrate carriers possible without feeding printing substrates in order to correct other influences on registration, since the influence of the properties of the printing substrates is detected and compensated for in a satisfactory manner by the measure according to the invention.

As a result of the invention, a registration setting of known type can be optimized with the effect that, when a printing substrate grade is changed, it does not "get out of hand" initially in order to be corrected again later, but rather the registration setting remains within the range of tolerable fluctuations, so that during a change to a different grade of printing substrate, it is possible to continue to print without interruption. At the same time, the invention does not exclude additionally taking into account other influencing variables, which are necessitated by a printed page but not by the printing substrate grade. One example of such an influencing variable is the application of toner, which is determined by the motif in the image and results in a different toner profile with respect to each color separation. In the measure according to the invention, nor does it matter either whether the printing substrate carrier with the printing substrates cooperates directly with the image cylinders in order to transfer the color separations, or whether image transfer cylinders are interposed.

A development of the method provides that in the event of a registration correction because of a change in printing substrate grade, the retroactive influence of the properties of the printing substrate of printed pages which have gone before but are still in the printing process on the registration of the new printed page that is already in the printing process is taken into account. In this case, for each printing unit, account is taken of the fact that the influences on registration are still determined by the printing substrates of the preceding printed pages while the setting of an image on the image cylinder with a color separation for the new printed page is already being performed. Furthermore, it is also taken into account that this change in the printing substrate properties, which have a relevant influence on registration, takes place successively on one printing unit after the other, that is to say, "runs through the machine".

In the described way, the maintenance of registration of the prints in the event of a change to the printed page is still better ensured. The printing machine can also continue to print without any interruption if, between the setting-up of two color separations, the printed-page change takes place in such a way that the new color separation is already being set up while the preceding color separation of the previous printed page has not yet been transferred, or not completely transferred, to the printing substrate. The maintenance of registration is, therefore, ensured to a high degree, and any mutual influence is compensated for, even when different printing substrate grades are printed one after another, even if these change with each printed page. As a result, the economy of the printing machine is significantly increased, and its use for printing individual jobs becomes more efficient.

With regard to the apparatus, this is achieved by the at least one controller being such that in the event of a registration correction because of a change in the printing substrate grade, the retroactive influence of the properties of the printing substrate of the printed pages which have gone before but are still in the printing process on the registration of the new printed page that is already in the printing process is taken into account.

The properties of printing substrates can be taken into account on the basis of stored data for the common printing substrate grades or those that are repeatedly used. A change in the printing substrate grade can be taken into account by storing data on printed pages to be processed. This is recommended in the case of all machines, which, under computer control, process a series of printed pages and different printing substrates, all the essential data on the printed pages, and also the data on the printing substrate to be used, being available. The advantage resides in an automatic procedure that can be implemented by appropriate software.

With regard to the apparatus, in order to take into account the properties of the common printing substrate grades, provision is made for it to be equipped with at least one memory, which contains stored data on correction values of common printing substrate grades or those that are repeatedly used, the at least one controller controlling the actions of setting up and combining the color separations on the basis of this data. Taking account automatically of data about printing substrates is achieved, with regard to the apparatus, by the latter being equipped with a memory to be loaded with data on printed pages to be processed, and the at least one controller determining the necessary correction values from this data. Determining the correction values from the data can be both a direct removal of the same or an access instruction which links the controller with the above-mentioned data on printing substrates for common printing substrate grades or those that are repeatedly used.

In addition, it is possible for a new grade of printing substrates to be identified by measuring properties of this printing substrate before the latter is fed to the printing process. With regard to the apparatus, for this purpose a device for measuring the properties of printing substrates is needed, as is a controller, which performs the identification. When measuring properties for identification, these do not have to be properties, which have an influence on registration. Since only one determination of the identity is necessary, light reflection or color could also be used, for example. Further properties such as the paper weight or printing substrate thickness are possible. In addition, a number of properties can be linked for the purpose of unequivocal identification.

Another possibility of determining the correction values for a printing substrate is in correction values for various properties of printing substrates being available as stored data, and in these properties being determined and the correction values resulting from these properties being taken into account. With regard to the apparatus, provision is then made for it to be equipped with at least one memory, which is loaded with data for various properties of printing substrates, for it to have a device for measuring properties of printing substrates, and for the at least one controller to be such that it uses the correction values that result from these properties as a basis for setting registration.

However, given this type of determination of correction values, the influences of various properties, such as the printing substrate thickness, the surface condition, the stiffness and so on, have to be detected separately, in order then to determine the correction values for the respectively determined sum of various properties of an actual printing substrate grade. This procedure is particularly suitable when the printing substrate grades are not common ones or repeating ones.

A new grade of printing substrates can also be taken into account on the basis of a manual input. In this case, the correction values themselves can be input, or it is possible for access to be made back to stored data as a result of the input of an identification. With regard to the apparatus, an input device is provided via which the correction values or the identification can be input.

It is expedient for the correction values for various printing substrates to be machine-specific values based on experience, which can be input manually or advantageously stored in at least one memory belonging to the printing machine. "Machine-specific" can relate to a specific machine or to a specific machine type. The values based on experience can be determined by proofs and corrected continually by evaluating prints during continuous operation.

In essential terms, the invention pursues the aim of serving to correct an existing registration control system. The latter can be such that it is based on the detection of registration marks, which are printed by the individual printing units. In this case, the invention provides for this correction to be carried out before a change can have any influence on registration marks. For the apparatus, provision can also be made for the at least one controller to be such that it controls registration by registration marks which are printed by the individual printing units and detected by a registration sensor, and takes the correction values into account before a change in the printing substrate grade can have any influence on registration.

However, the invention can also be used to correct a registration control system, which is based on the detection of the positions of the elements that carry the color separations and substrate. With regard to the apparatus, provision is then made for the at least one controller to be such that it controls the registration by detecting the positions of the elements that carry the color separations and substrate by position detecting elements, and takes the correction values into account before a change can have any influence on the registration marks. The position detecting elements may be rotary encoders.

If the invention is used to correct one of the above-mentioned registration controllers, then a significant advantage of the invention comes into play. Since the invention takes the influence of a printing substrate grade fully into account, the preceding registration setting can be carried out with the machine idling, without any printing substrates. Registration marks can also be detected without any printing substrates, by their being printed directly onto the carrier and then removed again. In this way, no printing substrates are used up for the registration setting.

Of course, provision can be made for further influences on registration resulting from a printed-page change to be taken into account when controlling the registration. This may be, for example, taking into account the toner profiles of the color separations of a specific print. With regard to the apparatus, provision must then be made for at least one controller, which takes these further influences into account, for example the toner profiles.

Of course, provision can also be made for further variables which have an influence on registration because of a printed-page or printing-substrate change to be taken into account when setting registration. These may be, for example, toner profiles, paper grades, the paper stiffness or other influencing variables. With regard to the apparatus, provision must then be made of at least one controller, which takes the further influencing variables into account.

The invention, and its objects and advantages, will become more apparent in the detailed description of the preferred embodiment presented below.

BRIEF DESCRIPTION OF THE DRAWINGS

The invention will be explained below with reference to the drawings, in which.

DETAILED DESCRIPTION OF THE INVENTION

Figure 1:
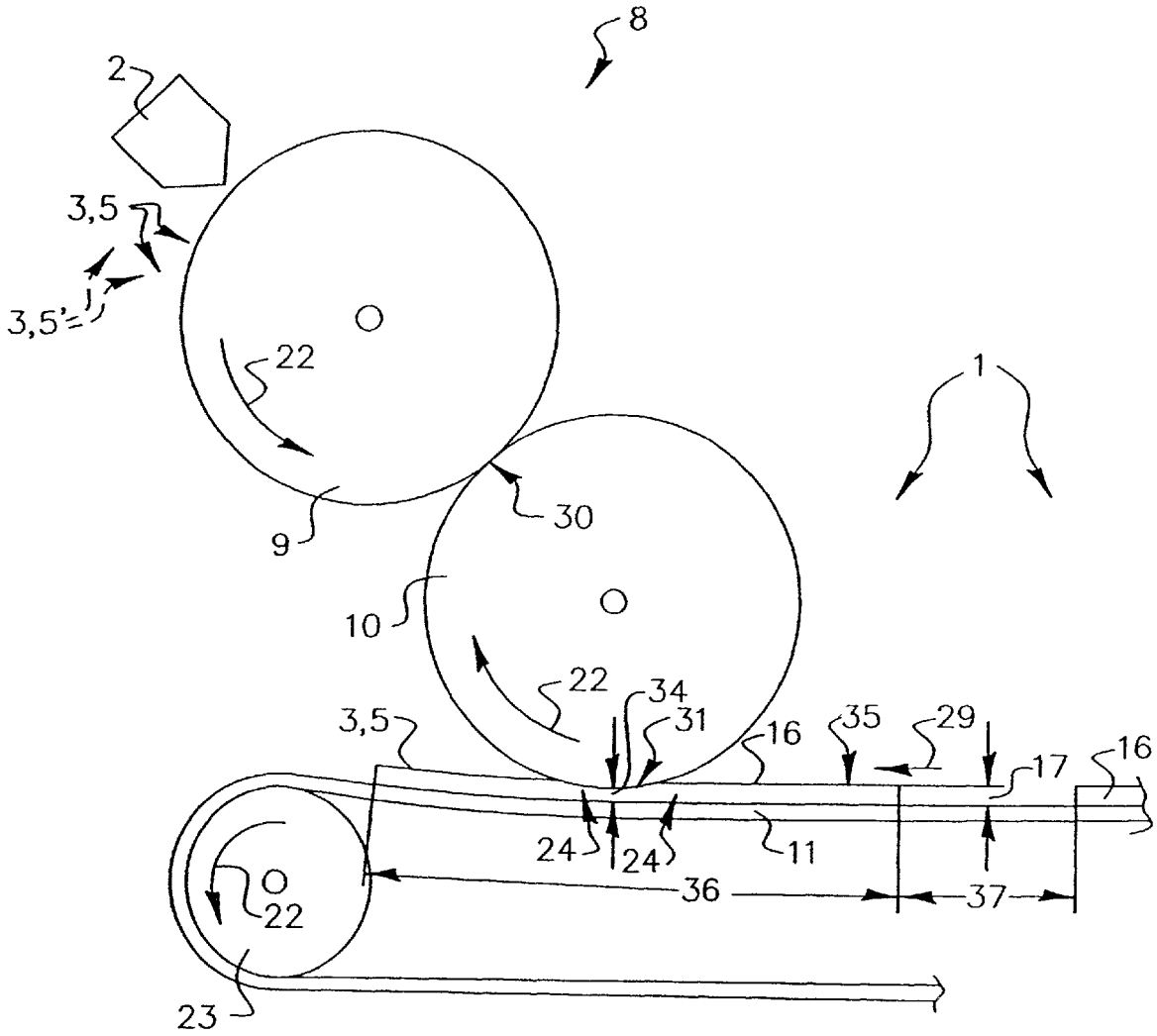
FIG. 1 shows an explanation of the influence of some printing substrate properties on registration.

FIG. 1 is used to explain the influence which some printing substrate properties have on registration, a change in the printing substrate thickness 17 in the event of a change to the printed pages having the main influence on registration.

The figure shows a printing unit 8 of a multicolor printing machine 1. Multicolor printing machines 1 have a number of substantially similar printing units, which have to be imagined as being added here. The printing unit 8 has an exposure device 2 for the digital production of color separations 3 on an image cylinder 9. The color separation 3 is taken onto an image transfer cylinder 10 by a transfer in the nip 30 from the image cylinder 9. By a further transfer in the nip 31, the color separation 3 passes onto a printing substrate 16. The printing substrates 16 are transported by a printing substrate carrier 11, the printing substrates 16 passing through all the printing units 8, 8', . . . one after another.

In many multicolor printing machines 1 with digital production of color separations 3, 3' . . . , the drive is provided by a drive roller 23 of the printing substrate carrier 11. In the exemplary embodiment illustrated, the printing substrate carrier 11 in turn drives the image transfer cylinders 10, 10', . . . , and the latter drive the image cylinders 9, 9' . . . Of course, the printing substrate carrier 11 could also drive the image cylinders 9, 9', . . . directly. This is the case in machines, which do not have any image transfer cylinders 10, 10', . . . In this case, the arrows 22 show the directions of rotation of the cylinders 9, 9', . . . ; 10, 10', . . . , and the arrow 29 shows the transport direction of the printing substrates 16 and, therefore, the direction of movement of the printing substrate carrier 11.

However, since the printing substrate carrier 11 with the printing substrates 16 is connected by friction to the image transfer cylinders 10, 10', . . . , and the latter are connected by friction to the image cylinders 9, 9', . . . , since for example the carrier 11 drives the image transfer cylinder 10, a curved attitude 24 is formed at the transfer nip 31, and such attitude influences the speed of the image transfer cylinder 10. If, for example, the printing substrate thickness 17 is changed in the direction of a thicker paper, then the effective radius for driving the image transfer cylinder 10 increases, since the printing substrate thickness 17 is included in such radius. The effective circumference of the image transfer cylinder 10, therefore, becomes greater and, as a result, the image transfer cylinder 10 becomes slower in relation to the drive roller 23. However, this problem does not depend on whether the drive is introduced at the drive roller 23 or at another point, since the surfaces of the elements 9, 9', . . . ; 10, 10', . . . ; 11 carrying the color separations and substrate roll on one another in any case.

Of course, it is not only the printing substrate thickness 17, which exerts influence on registration. A further influence results from the slippage produced as force is transmitted between the printing substrate 16 and the image transfer cylinder 10. This slippage is, in turn, determined by the coefficient of friction and, therefore, by the surface condition 35 of the printing substrate 16 and by the contact pressure 34. The contact pressure 34, in turn, increases as the printing substrate thickness 17 increases. Since the transmission of force in the gaps 37 between the printing substrates 16 is provided by the printing substrate carrier 11, finally the lengths 36 of the printing substrates 16 and the spacings of the gap 37 between the printing substrates 16 have to be included in the controller for setting up the color separations 3, 3', . . . , in order to achieve an accurately registered combination of the latter.

In addition to the aforementioned printing substrate properties, however, others may also play a part in influencing registration. It may transpire, precisely in the case of unusual printing substrates, that properties, which do not play any part in other printing substrates, have an influence on registration. For this reason, it is expedient if the properties of printing substrates 16 are taken into account on the basis of stored data 6 (see FIG. 2) which contain correction values as values based on experience, which take into account all the properties in total. In this case, the manufacturer of the printing machine can make data 6 for conventional printing substrate grades available and the printer has the possibility of determining data 6' for further printing substrates 16 by detecting proofs, for example by printing and evaluating registration marks 7, 7', . . . , and to store these data if these printing substrates 16 are processed relatively frequently.

Using FIG. 1, a further problem will also be explained below: while the color separation 3 of the preceding printed page 5 is being transferred from the image transfer cylinder 10 to a printing substrate 16, it is possible that the image cylinder 9 is already being set with the color separation 3 of a new printed page 5' by the exposure device 2. This is indicated by the reference symbols 3 and 5' and the dashed arrows. In this case, in order to maintain registration of the new printed page 5', the printing substrate properties of the printing substrates of the previous printed page 5 must be included in the calculations for setting the image on the image cylinder 9. For this reason, a development of the invention provides for the at least one controller 12, 12', . . . (see FIG. 2) to be such that in the event of a registration correction because of a change to the printing substrate grade, the retroactive influence of the variables 4 of the printing substrate properties of the printed pages 5, which have gone before but are still in the printing process, on registration of the new printed page 5', already in the printing process, is taken into account. By this measure, it becomes possible to print printed pages 5, 5' one after another on different printing substrates 16 and, in the process, to avoid registration faults because of this change in the printing substrate grades.

Figure 2:
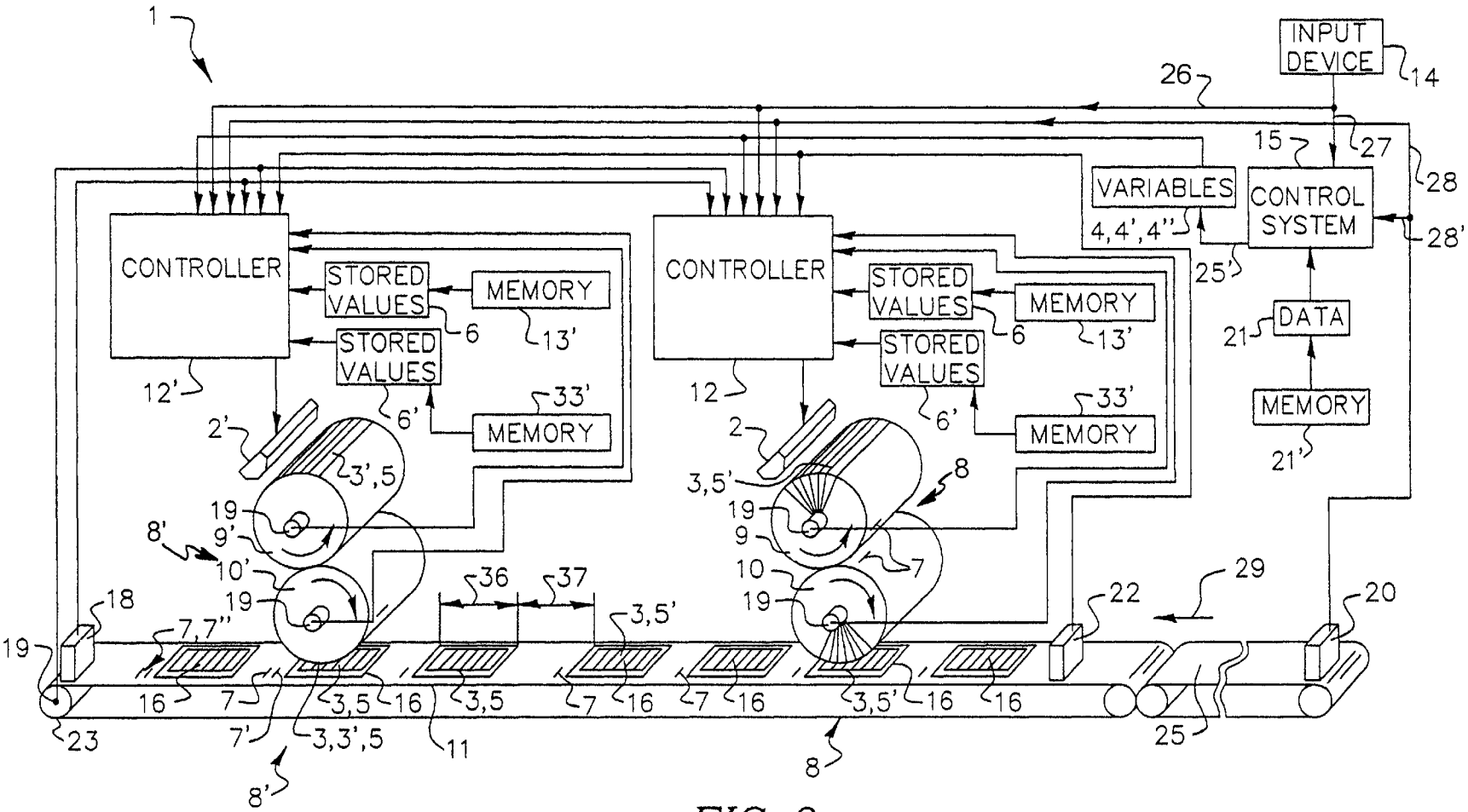
FIG. 2 shows an exemplary embodiment of the invention.

FIG. 2 shows an exemplary embodiment of the invention, a multicolor printing machine 1 having two printing units 8, 8' being illustrated. This is also a simplification; there are normally four or more printing units 8, 8', . . . These have to be imagined as being added.

As has already been described, the multicolor printing machine 1 has exposure devices 2, 2', . . . for the digital production of color separations 3, 3', . . . on image cylinders 9, 9', . . . By these exposure devices 2, 2', . . . , for each print new color separations 3, 3', . . . are set up, as a result of which each image can be different and can also be printed on a different grade of printing substrates 16.

Each printing unit 8, 8', . . . has an image cylinder 9, 9', . . . and an image transfer cylinder 10, 10', . . . , the latter transferring the color separations 3, 3', . . . to the printing substrates 16. The printing substrates 16 are transported through the printing machine 1 in the direction of the arrow 29 by a printing substrate carrier 11.

In order that the color separations 3, 3', . . . are produced by the exposure devices 2, 2', . . . such that they are transferred in-register to the printing substrates 16, controllers 12, 12', . . . are provided, which control the exposure device 2, 2', . . . such that image starts, lines or areas of the color separations 3, 3', . . . are coordinated with one another. The controllers 12, 12', . . . can each be assigned to a respective printing unit 8, 8', . . . , or it is possible that their task is taken over by a printing-machine control system 15 for the entire multicolor printing machine 1.

Controllers 12, 12', . . . (or system 15) can be configured such that each printing unit 8, 8', . . . prints a registration mark 7, 7', . . . , and these registration marks 7, 7', . . . are detected by a registration sensor 18. The evaluation of the position of registration marks 7, 7', . . . then gives the relation of the color separations 3, 3', . . . In the event of deviations, a correction can be made such that the color separations 3,3', . . . are transferred in-register to the printing substrates 16.

A further possibility that may be provided as an alternative is the image cylinders 9, 9', . . . and, if appropriate, also the image transfer cylinders 10, 10', . . . , are equipped with position detecting elements 19, for example, with rotary encoders. A further rotary encoder 19 is provided on the drive roller 23 of the printing substrate carrier 11. By these position detecting elements 19, the positions of the cylinders 9, 9', . . . ; 10, 10', . . . and of the printing substrate carrier 11 can be set in relation to one another. As a result, it is possible to detect positional displacements and to correct them by the controllers 12, 12', . . . in order that an accurately registered print can be achieved.

Although a change to registration resulting from a change in the printing substrate properties can be detected and corrected both by detecting the register marks 7, 7', . . . and by detecting the position, this has the disadvantage that the effect of the change of the properties of printing substrates 16 must already have occurred in order to be able to detect and correct it. Using this, ongoing continuous printing between a preceding printed page 5 and a new printed page 5' is not possible if the printing substrate grade changes at the same time.

The invention, therefore, provides for the at least one controller, 12, 12', . . . (control system 15) to be such that, with the aid of existing correction values of variables 4, 4', . . . from printing substrates 16, their influence on registration is taken into account directly with a change in the printed page 5, 5'. These correction values of variables 4, 4', . . . may be correction values which are assigned to specific printing substrate grades, or correction values which are assigned to various printing substrate properties.

One possibility for taking into account the correction values of variables 4, 4', . . . of various printing substrate grades or various printing substrate properties is for data on printed pages 5, 5', including the printing substrates to be used, to be input at an input device 14. This data is transferred onward from the input device 14 to the controllers 12, 12', . . . via a connection 26. The controllers 12, 12', . . . can call up stored value data 6, based on experience for various printing substrate grades on the basis of this data on the printed pages 5, 5', . . . , from the memories 13, 13', . . . As a result, the correction values which belong to the same can be obtained and are taken into account by the controllers 12, 12', . . . without any time delay. In this way, the exposure devices 2, 2', . . . are capable of performing the digital production of color separations 3, 3', . . . without interruption and in-register even when changing printing substrate grades are being printed. The stored value data 6 can be stored in the memories 13, 13', . . . directly as correction values or for the calculation of the same for the individual printing units 8, 8', . . .

With regard to determining the correction values of variables 4, it is also possible for data on printed pages 5, 5', . . . to be provided to the printing-machine control system 15 via the input device 14 and a connection 27. Such printing-machine control system 15 can call up correction values of variables 4, via stored data 21 from print jobs from a memory 21', contained there and to be taken into account—or data for calculating the same—for various printing substrate grades 16. The particular advantage of this embodiment is that virtually everything is carried out via data processing, and that correction values which are present, as values based on experience include all the known or even unknown effects of properties of the printing substrate grade on registration. The correction values which the printing-machine controller 15 receives from the stored data 21 from the memory 21' are transmitted onward to the controllers 12, 12', . . . via a connection 25'.

A further embodiment provides for a device 20 for measuring printing substrate properties to be provided. The device 20 measures the properties of the printing substrates 16 fed to the multicolor printing machine 1 (for example, by a transport belt 25), which are relevant to the influence of such properties on registration, at least when the printing substrate grade is changed. On the basis of this measurement, correction values, which are assigned to various printing substrate properties, can be called up and taken into account, while taking account of any possible interactions, such as in the case of printing substrate thickness 17 and contact pressure 34. It is also possible that, on the basis of the measurement, the stored values data 6' is selected appropriately, it being possible for this data to take into account interactions in that they contain correction values for combinations of properties of printing substrates 16.

In the illustration of FIG. 2, the printing unit 8 is already printing the color separation 3 of the new printed page 5' while the printing unit 8' is still printing the color separation 3' of the preceding printed page 5. Depending on the instant illustrated, the printed page change can also be located at a different point, for example, within a printing unit 8, 8', . . . , as was described in FIG. 1. In the exemplary embodiment illustrated, a change to the printed page 5, 5', . . . takes place with a change to the printing substrate grade, between the printing units 8 and 8', without the distance 37 between the printing substrates 16 being greater than in the case of the same substrate grade printed pages 5 or 5'. The printing machine can, therefore, print one printed page 5' after the other printed page 5 without any interruption, even if changing printing substrate grades are used, by taking into account the influence of the properties of the printing substrate 16 of the preceding printed pages 5 on registration of the new printed page 5'—as was explained in relation to FIG. 1.

In order that the controllers 12, 12', . . . (and control system 15) can assign to printed page 5 the color separations 3, 3', . . . to the printing substrates 16, a sensor 22 for detecting the position of printing substrates 16 must also be arranged at the start of the printing substrate carrier 11. This sensor informs the controllers 12, 12', . . . about the position in which a printing substrate 16 is located on the printing substrate carrier 11.

The exemplary embodiment of FIG. 2 is not meant to be all inclusive, and it is not necessary for all the alternatives illustrated to be provided in one machine. For example, it is also possible to provide only one input device 14 with a connection 26 to the controllers 12, 12', . . . , which call up the stored value data 6 for various printing substrate grades on the basis of the input of the printing substrate grade. Alternatively, provision may be made for the correction values of variables 4 to be input directly at the input device 14 in the event of a printing substrate change, or for the correction values to be taken from a memory 21' by the printing machine control system 15, since such correction values are contained in the data 21 on printed pages 5, 5'. . . In the event of a change to the printed page 5, 5', . . . , this data 21 can also be interrogated automatically for changed correction values. A further possibility, which is likewise possible separately, is to measure printing substrate properties by the described device 20, in order to call up stored correction values of variables 4', . . . or stored value data 6', . . . in order to calculate the latter.

However, it is most expedient to provide all the possibilities in the manner illustrated in one machine, in order to be able to select one or the other alternative on the basis of the data available or the critical influencing variables during the operation of the machine. However, the configurations are only exemplary; other methods for obtaining, inputting or allocating data which characterizes the properties of printing substrates 16, and other methods of processing said data, are conceivable.

The invention has been described in detail with particular reference to certain preferred embodiment thereof, but it will be understood that variations and modifications can be effected within the spirit and scope of the invention.

PARTS LIST

1 Multicolor printing machine
2, 2', . . . Exposure devices for the digital production of color separations
3, 3', . . . Color separations
4, 4', . . . Correction values for various printing substrates
4 Correction values which are assigned to specific printing substrate grades
4', . . . Correction values which are assigned to various printing substrate properties (thickness, surface condition, stiffness . . . )
5, 5' Printed pages
5 Preceding printed page
5' Following printed page
6, 6' Stored data for various printing substrates
6 Stored data for various printing substrate grades
6' Stored data for various properties of printing substrates
7, 7', . . . Registration marks
8, 8', . . . Printing units
9, 9', . . . Image cylinder
10, 10', . . . Image transfer cylinder
11 Printing substrate carrier
12, 12', . . . Controller for achieving in-register prints (for example, assigned to the printing units)
13, 13', . . . Memories with data for various printing substrate grades
14 Input device
15 Printing machine controller
16 Printing substrates
17 Printing substrate thickness, for example, paper thickness
18 Registration sensor
19 Position detecting element, for example, rotary encoder
20 Device for measuring printing substrate properties
21 Data from print jobs
21' Memory for data from printed pages
22 Sensor for detecting printing substrates
23 Drive roller of the carrier for printing substrates
24 Curved attitude
25 Transport belt for feeding printing substrates to the multicolor printing machine
26 Connection between input device and controllers
27 Connection between input device and printing-machine controller
27' Connection between printing-machine controller and controllers (assigned to the printing units)

28 Connection between device 20 and controllers (assigned to the printing units)
28' Connection between device 20 and printing-machine controller
29 Arrow: transport direction
30 Transfer of a color separation from the image cylinder to the image transfer cylinder
31 Transfer of a color separation from the image transfer cylinder to a printing substrate
32 Arrow: directions of rotation
33, 33', . . . Memory with data for various properties of printing substrates
34 Contact pressure
35 Surface condition of the printing substrate
36 Length of the printing substrate
37 Distance from the next printing substrate

What is claimed is:

1. A method of setting registration in a multicolor printing machine (1) having a number of individual printing units (8, 8') and a respective number of exposure devices (2, 2') for the digital production of color separations (3, 3'), and a registration control system which is based on the detection of registration marks (7, 7') which are printed by said individual printing units (8, 8'), the actions of setting up and combining the color separations (3, 3') being controlled when printing substrates (16) of a different grade are fed in, in order to correct the registration setting, wherein: when a printing substrate grade is changed, the influence of all the properties of said printing substrate (16) that are relevant to registration is taken into account directly as the change is implemented, by correction values (4, 4') for said printing substrate (16) that are available before printing is carried out, before a change in the printing substrate grade can have any influence on the registration marks (7, 7'), such that retroactive influence of properties of said printing substrate (16) of printed pages (5) which have gone before but are still in the printing process on registration of a new printed page (5') that is already in the printing process is taken into account.

2. The method as claimed in claim 1, wherein properties of printing substrates (16) are taken into account on the basis of stored data (6) for common printing substrate grades or those that are repeatedly used.

3. The method as claimed in claim 2, wherein a new grade of printing substrates (16) is identified by measuring properties of such printing substrate (16) before the latter is fed to the printing process.

4. The method as claimed in claim 3, wherein correction values (4, 4') for various properties of printing substrates (16) are available as stored data (6'), and wherein these properties are determined and the correction values (4, 4') resulting from these properties are taken into account.

5. The method as claimed in claim 4, wherein a new grade of printing substrates (16) is taken into account on the basis of a manual input.

6. The method as claimed in claim 4, wherein the correction values (4, 4') for various printing substrates (16) are machine-specific values based on experience.

7. The method as claimed in claim 1, wherein a change in the printing substrate grade is taken into account by storing files (21) on printed pages (5, 5') to be processed.

8. The method as claimed in claim 1, wherein said method is used to correct a registration control system which is based on detection of the positions of elements (9, 9', 10, 10'; 11) that carry color separations and substrate, before a change in the printing substrate grade can have any influence on registration marks (7, 7') positions of said elements (9, 9', 10, 10').

9. The method as claimed in claim 1, wherein further influences on registration resulting from a printed page change (5, 5') are taken into account when setting registration.

10. The method as claimed in claim 1, wherein the toner profile of color separations (3, 3') of printed pages (5, 5') is taken into account.

11. Apparatus for a multicolor printing machine (1) having a number of individual printing units (8, 8') and a respective number of exposure devices (2, 2') for the digital production of color separations (3, 3'), at least one controller (12,12'), which controls registration by registration marks (7, 7') printed by individual printing units (8, 8') and detected by a registration sensor (18), performing a registration correction by controlling the actions of producing and combining color separations (3, 3') when printing substrates (16) of a different grade are fed in, wherein: at least one controller (12, 12'; 15) is such that when a printing substrate grade is changed, the influence on registration of all the properties of the printing substrate (16) that are relevant to registration is taken into account directly as the change is implemented, by available correction values (4, 4') for said printing substrate (16), taken into account before a change in the printing substrate grade can have any influence on registration marks (7, 7'), and the retroactive influence of the properties of the printing substrate (16) of printed pages (5) which have gone before but are still in the printing process on the registration of a new printed page (5') that is already in the printing process is taken into account.

12. The apparatus as claimed in claim 11, further including at least one memory (13, 13'), which contains stored data (6) on correction values (4, 4') of common printing substrate grades or those that are repeatedly used, said at least one controller (12, 12') controlling the actions of setting up and combining color separations (3, 3') on the basis of said stored data (6).

13. The apparatus as claimed in claim 12, further including an input device (14) via which the action of taking the correction values (4, 4') into account can be activated manually.

14. The apparatus as claimed in claim 12, wherein correction values (4, 4') contained in said at least one memory (13, 13'; 21'; 33, 33') are machine-specific values based on experience.

15. The apparatus as claimed in claim 11, further including a memory (21') to be loaded with data (21) on printed pages (5, 5') to be processed, and said at least one controller (12, 12') determines the necessary correction values (4, 4') from said loaded data (21).

16. The apparatus as claimed in claim 11, further including a device (20) for measuring properties of printing substrates (16), and a new grade of printing substrates (16) is identified by said at least one controller (12, 12'; 15) by said properties.

17. The apparatus as claimed in claim 11, further including at least one memory (33, 33'), which is loaded with data (6') for various properties of printing substrates (16), a device (20) for measuring properties of printing substrates (16), and said at least one controller (12, 12'; 15) uses the correction values (4') that result from said properties as a basis for setting registration.

18. The apparatus as claimed in claim 11, wherein said at least one controller (12, 12') is such that it controls registration by detecting the positions of elements (9, 9'; 10, 10'; 11) of said printing machine (1) that carry color separations and substrates by position detecting elements (19), and takes correction values (4, 4') into account before a change in the printing substrate grade can have any influence on such positions of said printing machine elements (9, 9'; 10, 10'; 11).

19. The apparatus as claimed in claim 11, wherein said at least one controller (12, 12') is such that it takes into account further influences on registration resulting from a printed page change (5, 5') when setting registration.

20. The apparatus as claimed in claim 11, wherein said at least one controller (12, 12') is such that it takes into account toner profile of color separations (3, 3') of printed pages (5, 5').

* * * * *